US007562980B2

(12) United States Patent
Rymniak

(10) Patent No.: US 7,562,980 B2
(45) Date of Patent: Jul. 21, 2009

(54) OPTICAL DEVICE FOR PROVIDING PRESCRIPTION CORRECTION TO A MIRROR

(76) Inventor: Candace Rymniak, 51 Columbus Dr., Franklin Park, NJ (US) 08823

( * ) Notice: Subject to any disclaimer, the term of this patent is extended or adjusted under 35 U.S.C. 154(b) by 92 days.

(21) Appl. No.: 11/739,876

(22) Filed: Apr. 25, 2007

(65) Prior Publication Data

US 2007/0247692 A1 Oct. 25, 2007

Related U.S. Application Data

(60) Provisional application No. 60/745,576, filed on Apr. 25, 2006.

(51) Int. Cl.
*G02C 7/02* (2006.01)
*G02B 27/02* (2006.01)
*G02C 7/14* (2006.01)

(52) U.S. Cl. ..... 351/159; 359/802; 359/803; 351/50

(58) Field of Classification Search ..... 359/802
See application file for complete search history.

(56) References Cited

U.S. PATENT DOCUMENTS 3,677,620 A * 7/1972 Bettencourt ..... 359/482
3,970,369 A 7/1976 Wachsman
4,709,657 A * 12/1987 Gothard ..... 119/253
4,925,287 A * 5/1990 Lord et al. ..... 359/872
5,442,488 A * 8/1995 Pastorino ..... 359/802
6,305,809 B1 * 10/2001 Zadro ..... 359/840
6,441,969 B1 8/2002 Goldstein et al.

* cited by examiner

*Primary Examiner*—Jordan M. Schwartz
*Assistant Examiner*—James C Jones
(74) *Attorney, Agent, or Firm*—Roy J Rosser

(57) ABSTRACT

An optical device for providing prescription correction to a mirror so that a person who normally wears prescription glasses may clearly see, and also have unobstructed access to, their face in order to apply makeup. A magnifying lens in the form of an eyeglass blank of an appropriate corrective power is removably attached to the mirror by means of a suction cup and a hook element. The magnifying lens has a hole joining its two refracting surfaces. One end of the hook element fits through the hole and the other end of the hook element is attached to the suction cup. The lens situated in close proximity to the mirror provides a user who normally wears prescription eyeglasses with the appropriate corrective power to enable them to clearly see their face while providing good working room for them to perform tasks such as applying their makeup.

16 Claims, 4 Drawing Sheets

OPTICAL DEVICE FOR PROVIDING PRESCRIPTION CORRECTION TO A MIRROR

CROSS REFERENCE TO RELATED APPLICATIONS

This application is related to, and claims priority from, U.S. Provisional Patent application No. 60/745,576 filed on Apr. 25, 2006 by Candace Rymniak entitled "Optical Apparatus for Providing Prescription Correction to a Mirror", the contents of which are hereby incorporated by reference.

FIELD OF THE INVENTION

The present invention relates to optical devices, and more particularly to optical devices for providing prescription correction to mirrors to provide vision corrected, focused images at distances suitable for tasks such as applying cosmetics.

BACKGROUND OF THE INVENTION

People who wear prescription glasses have difficulty using mirrors for tasks such as applying cosmetics. Their face, particularly their eyes, is obstructed if they are wearing their glasses. Without their glasses, however, they cannot see their face clearly.

Many people have attempted to address this issue. A fairly recent summary of these attempts over the years is provided in, for instance, the background section of U.S. Pat. No. 6,441,696 issued to Goldstein et al. on Aug. 27, 2002 entitled "Prescription Mirror", the entire contents of which are hereby incorporated by reference.

An early summery is provided in, for instance, U.S. Pat. No. 3,970,369 issued to Wachsman on Jul. 20, 1976 entitled "Corrective makeup and employing prescription lenses", the contents of which are hereby incorporated by reference.

Despite the many attempts to address this issue, a simple, portable apparatus that can be used on existing mirrors to allow a person who normally wears prescription glasses to both see and have unobstructed access to their face, particularly their eyes, is still needed.

SUMMARY OF THE INVENTION

Briefly described, the invention provides a lens and a means for removeably attaching the lens to a mirror so as to enable a person who normally wears prescription glasses to both see and have unobstructed access to their face, and more particularly to their eyes, for the purpose of tasks such as, but not limited to, applying makeup.

In a preferred embodiment of the invention, a lens in the form of an eyeglass blank of an appropriate corrective power is removably attached to a mirror by means of a suction cup and a hook element. For use, the suction cup may be fixed to the mirror and the lens may, for instance, hang from the suction cup by means of the hook element.

The lens situated in close proximity to the mirror provides a user who normally wears prescription eyeglasses with the appropriate corrective power to enable them to clearly see their face while providing enough working room for them to perform tasks such as, but not limited to, applying their makeup. The lens arrangement of the present invention may be used on magnifying mirrors but it is also effective even if the mirror to which the lens is attached is a flat, non-magnifying mirror.

These and other features of the invention will be more fully understood by references to the following drawings.

DETAILED DESCRIPTION

The present invention applies to a simple, portable optical device for providing prescription correction to a mirror to provide vision corrected, focused images at suitable distances for such tasks as applying cosmetics.

An objective of the present invention is to provide a low cost, easy to use, portable device to enable people who normally wear prescription glasses a way to use a mirror while performing tasks such as, but not limited to, putting on their makeup.

A preferred embodiment of the invention will now be described in detail by reference to the accompanying drawings in which, as far as possible, like elements are designated by like numbers.

Although every reasonable attempt is made in the accompanying drawings to represent the various elements of the embodiments in relative scale, it is not always possible to do so with the limitations of two-dimensional paper. Accordingly, in order to properly represent the relationships of various features among each other in the depicted embodiments and to properly demonstrate the invention in a reasonably simplified fashion, it is necessary at times to deviate from absolute scale in the attached drawings. However, one of ordinary skill in the art would fully appreciate and acknowledge any such scale deviations as not limiting the enablement of the disclosed embodiments.

Figure 1:
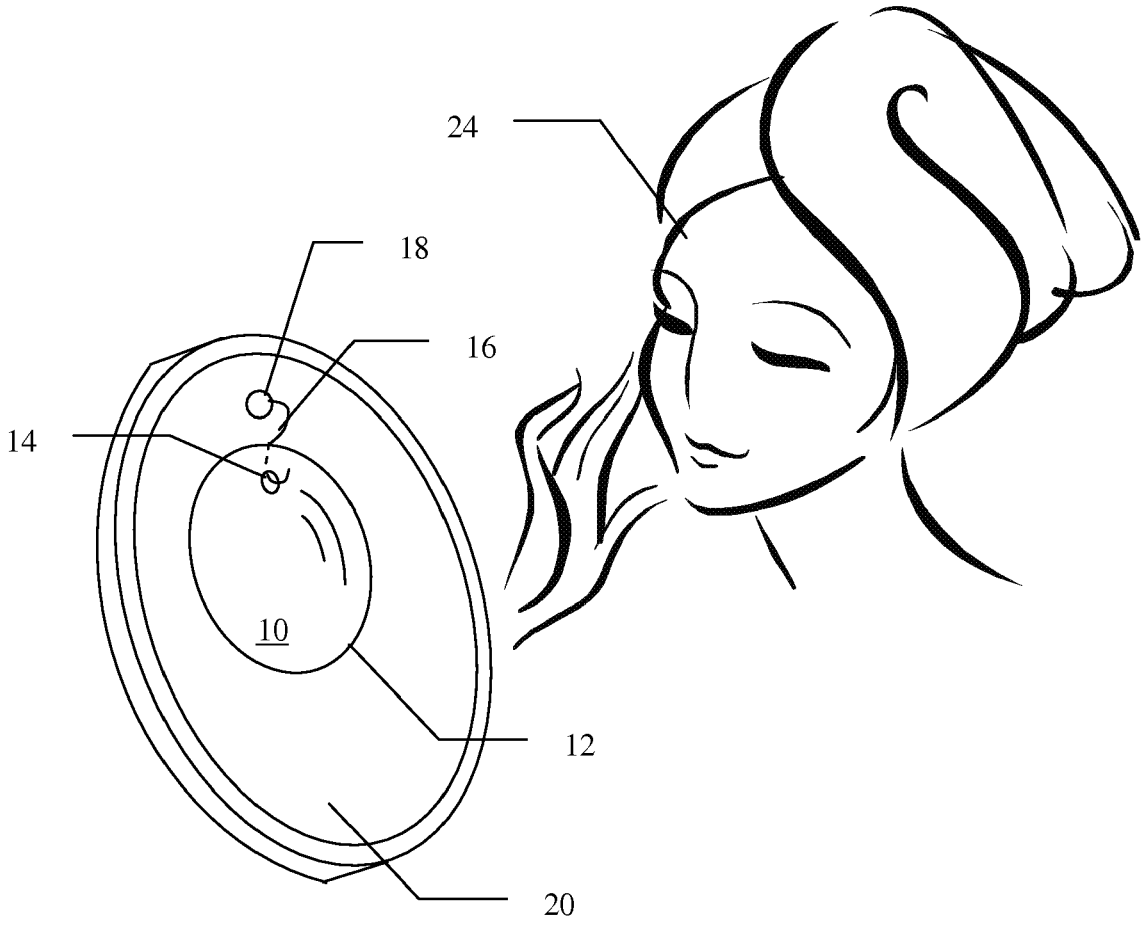
FIG. 1 is a three dimensional, schematic drawing of a preferred embodiment of the invention.

FIG. 1 is a three dimensional drawing of a preferred embodiment of a correction providing optical device 10. The correction providing optical device 10 includes an eyeglass optical lens blank 12, a suction cup 18 and a hook 16. The eyeglass optical lens blank 12 has a hole 14 machined in it that connects its two refracting surfaces. In use, the suction cup 18 is attached to a cosmetics mirror 20. The eyeglass optical lens blank 12 is suspended from the suction cup 18 by the hook element 16 that is fitted through the hole 14 that connects the two refracting surfaces of the lens. A user 24 who normally wears prescription glasses may use the cosmetics mirror 20 in combination with the correction providing optical device 10 to see their own face, particularly their eyes, clearly enough, and with enough working room, to perform tasks such as, but not limited to, applying makeup.

The eyeglass optical lens blank 12 may be a standard prescription eyeglass lens blank, without any additional edging but with a suitable hole 14 machined into it. The hole 14 connects the two refracting surfaces of the lens blank and is a suitable distance from the edge of the lens. Eyeglass lenses are typically curved meniscus lenses with the eye-side curve radius fixed at about 3.5 inches. Eyeglass lens blanks may be made of a variety of optical glass or plastic materials and are available in a variety of standardized sizes. For instance, Polycore Optical Pte. Ltd. of Singapore provides single vision finished lens blanks made from polycarbonate, hard resin and its propriety Index 1.56™ plastic in four diameters, 55 mm, 60 mm, 65 mm and 70 mm. Other manufactures also provide blanks with diameters of 75 mm and 80 mm.

Eyeglass lens powers are typically measured in diopters. This measure is related to the focal length of the lens by the formula:

Power in diopters=1000/focal length in mm.

A lens with a power of 2 diopters, therefore, has a focal length of 500 mm.

Lens blanks are typically available in 0.25 diopter increments. For instance, Polycore Optical Pte. Ltd. of Singapore provides its 55 mm and 60 mm diameter single vision finished blanks in powers from 0 diopters to +/−8.00 diopters in 0.25 Dioptor increments, and its 65 mm and 70 mm diameter single vision finished blanks in powers from 0 diopters to +/−6.00 diopters in 0.25 diopter increments. Polycore also provides 65 mm diameter, polycarbonate aspheric prescription lens blanks in 0.25 Diopeter increments from 0 to +/−6.00 diopters.

The suction cup 18 may, for instance, be a clear plastic suction cup with hook such as, but not limited to, the range of suction cups supplied by Popco, Inc. of Minnetonka, MN. Popco's line of suction cups includes 1¾" diameter cups made of medical grade PVC for superior suction capability.

Figure 2:
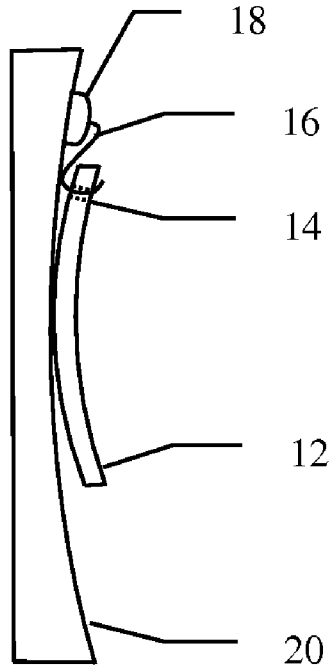
FIG. 2 is a cross-sectional drawing of a preferred embodiment of the invention attached to a concave mirror.

FIG. 2 is a cross-sectional drawing of a preferred embodiment of the invention attached to a concave mirror. Most cosmetics mirror 20 provide a degree of magnification. In this embodiment of the invention, the correction providing optical device 10 may augment the magnification provided by the cosmetics mirror 20 and provide any prescription correction required by the user 24.

In use, the suction cup 18 may be attached to a cosmetics mirror 20. A hook element 16 that may be formed of metal, plastic or any other suitable material has one end threaded through the hole or aperture 14 that has been machined through the eyeglass optical lens blank 12. The other end of the hook element 16 is attached to the suction cup 18 so that in combination they secure the eyeglass optical lens blank 12 against a reflecting surface of the cosmetics mirror 20. In a preferred embodiment, the eyeglass optical lens blank 12 is positioned so that a concave surface of the lens confronts the reflecting surface of the cosmetics mirror 20.

Figure 3:
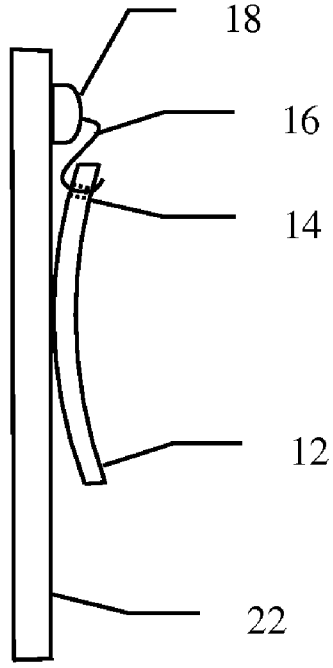
FIG. 3 is a cross-sectional drawing of a preferred embodiment of the invention attached to a flat mirror.

FIG. 3 is a cross-sectional drawing of a preferred embodiment of the invention attached to a flat mirror 22. In this embodiment, all the magnification is provided by the correction providing optical device 10.

Using an eyeglass optical lens blank 12 to provide the necessary magnification generally results in a better image quality than using a cosmetics mirror 20 alone to provide the same degree of magnification. The reason for this improvement in quality is the reduction in spherical aberration of the image.

The cosmetics mirror 20 has only a single reflecting surface, while the eyeglass optical lens blank 12 of the correction providing optical device 10 has two refracting surfaces. In the eyeglass optical lens blank 12 the refraction of the imaging rays can, therefore, be divided equally between the two surfaces while the reflection of the imaging rays must be accomplished by a single surface in the cosmetics mirror 20. For a given magnification, the eyeglass optical lens blank 12, therefore, typically introduces significantly less spherical aberration than the cosmetics mirror 20. Less spherical aberration results in a better image. Moreover, using an aspheric lens for the eyeglass optical lens blank 12 may reduce the spherical aberration even further.

The cosmetics mirror 20 introduces no chromatic aberration, while the eyeglass optical lens blank 12 typically introduces a small amount of chromatic aberration that depends primarily on the optical properties of the material of which the eyeglass optical lens blank 12 is made. The human eye is, however, fairly tolerant of small amounts of chromatic aberration.

Placing the eyeglass optical lens blank 12 in close proximity to the flat mirror 22 has an additional advantage of allowing a user 24 to use substantially the same lens prescription that they normally use for reading. The reason for this may be seen by reference to FIGS. 6A, 6B and 6C.

Figure 6A:
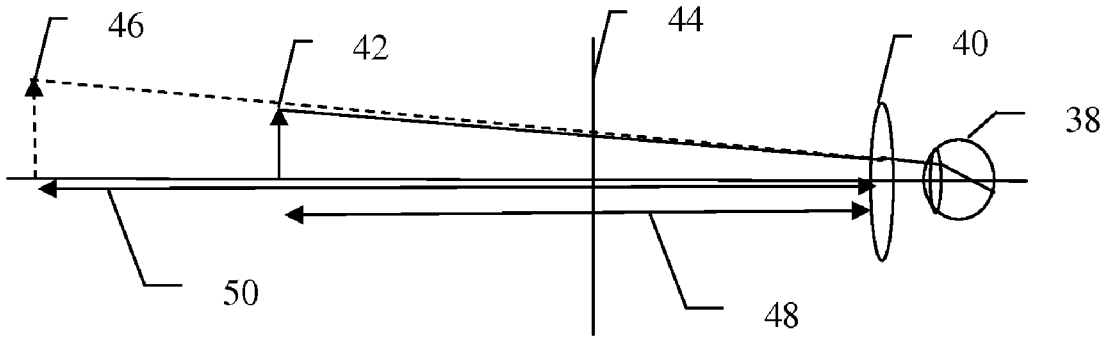
FIG. 6A is a schematic representation of a viewer looking at their own lips using a corrective lens and a mirror.

FIG. 6A is a schematic representation of a viewer looking at their own lips using a corrective lens and a mirror. The eye 38 is shown looking at an object 42 via a lens 40 and a mirror 44. The user's eye 38 sees the object 42, which may be their lips, as a magnified image 46. The lens-to-object distance 48 is roughly twice the distance from the eye 38 to the mirror 44. The lens-to-image distance 50 is related to the lens-to-object distance 48 and the power of the lens 40 by the laws of optics for thin lenses, that may be represented as the equation:

1/lens-to-object distance+1/lens-to-image distance=1/*f*

Where f represents the focal length of the lens 40. The focal length in mm equals 1000/power in diopters.

The magnification=the lens-to-image distance/lens-to-object distance.

EXAMPLE A

Lens power=2 diopters

Lens-to-object distance=23 mm

Lens-to-image distance=−42.5 mm

Magnification=1.85

Figure 6B:
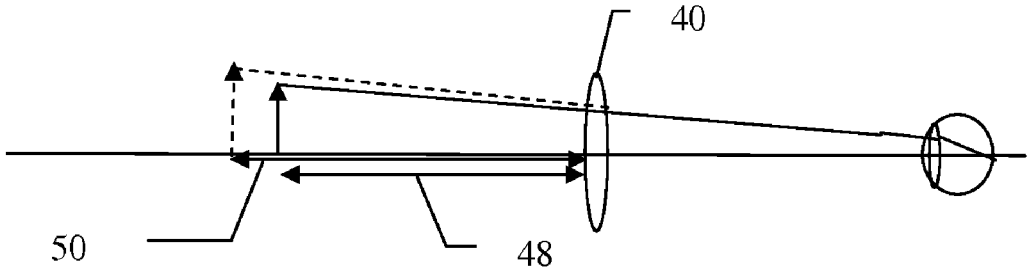
FIG. 6B is a schematic representation of a viewer looking at an object at an equivalent distance as their lips where in FIG. 6A using a corrective lens where the mirror in FIG. 6A was.

FIG. 6B is a schematic representation of a viewer looking at an object at an equivalent distance as their lips where in FIG. 6A using a corrective lens placed where the mirror in FIG. 6A was, but with the mirror removed.

EXAMPLE B

Assuming the same power lens as in example A,

Power of lens=2 diopters

Lens-to-object distance=12.5.

Lens-to-image distance becomes=16.5 mm

Magnification=1.33

Figure 6C:
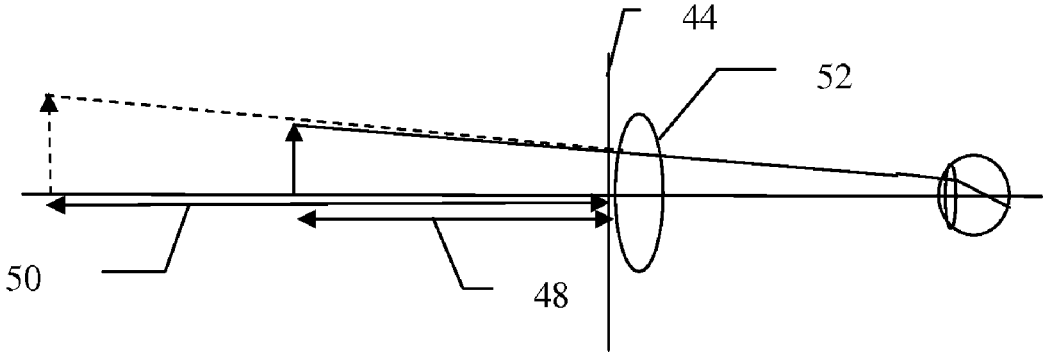
FIG. 6C is a schematic representation of a viewer looking at their own lips using a corrective lens placed in close proximity to a mirror.

Example B demonstrates that by moving the lens 40 approximately half-way to the object, the magnification of the image is significantly reduced, almost to half. FIG. 6C, however, shows the actual optical arrangement that occurs in using the correction providing optical device 10. When the lens is moved to being in close proximity to the mirror 44, all imaging rays pass through the lens 52 twice. The lens 52, therefore, effectively has twice the power of lens 40.

EXAMPLE C

Assuming the same lens as in example A, but having twice the optical power because of the imaging rays traversing it twice.

Lens power=4 diopters

Lens-to-object distance=12.5 mm

Lens-to-image distance=25 mm

Magnification=2

So same lens placed next to the mirror is slightly more effective in magnification at that position when looking at objects on the face such as, but not limited to the lips, than when worn as eye glasses because of double transit of the imaging rays through the lens. This has the interesting advantage of allowing a user 24 to use an eyeglass optical lens blank 12 having the same prescription as the lens in their reading glass for the correction providing optical device 10.

Figure 4:
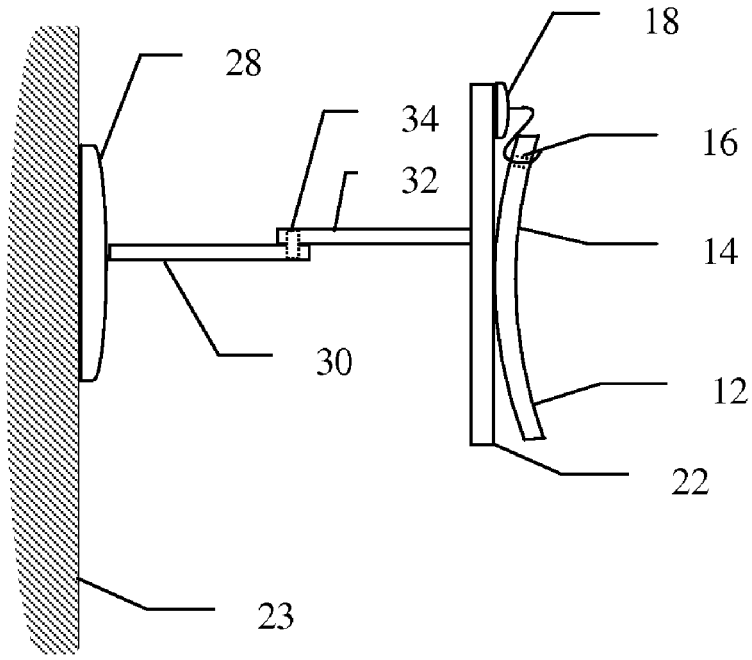
FIG. 4 is a cross-sectional drawing of a further preferred embodiment of the invention including a laterally pivoting extension arm.

FIG. 4 is a cross-sectional drawing of a further preferred embodiment of the invention including a laterally pivoting extension arm. The flat mirror 22 of the correction providing optical device 10 of this embodiment may be removably attached to a wall 23 by an attachment device 28 and a first arm 30 and a second arm 32. The first arm 30 is attached to the second arm 32 by a pivot joint 34. The pivot joint 34 allows the first arm 30 and the second arm 32 to pivot laterally with respect to each other, thereby allowing the correction providing optical device 10 to be positioned further from, or closer to, the wall 23. The attachment device 28 may be a suction device, a magnetic device for metal walls, or other suitable device for removably attaching an object to a wall or to a mirror. In this embodiment, the suction cup 18 may be replaced by a permanent fastening device.

Figure 5:
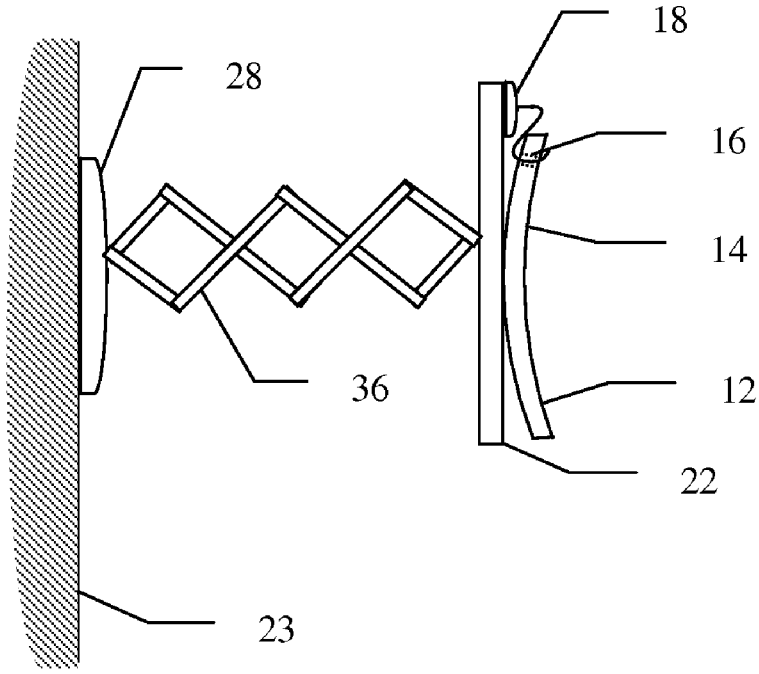
FIG. 5 is a cross-sectional drawing of a further preferred embodiment of the invention including a concertino extension arm.

FIG. 5 is a cross-sectional drawing of a further preferred embodiment of the invention including a concertino extension arm. The correction providing optical device 10 of this further embodiment is removably attached to the wall 23 by a concertino extension arm 36 and an attachment device 28. In this embodiment, the suction cup 18 may be also replaced by a permanent fastening device.

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention. Modifications may readily be devised by those ordinarily skilled in the art without departing from the spirit or scope of the present invention.

What is claimed:

1. A device for providing prescription correction to any one of a plurality of mirror surfaces, comprising:

a magnifying lens comprising a corrective eyeglass lens blank having a first and a second refracting surface and having a hole machined through said lens blank from said first refracting surface to said second refracting surface, said hole having a substantially constant cross-section; and means for removably attaching said magnifying lens to said any one of a plurality of mirror surfaces, using said hole.

2. The device of claim 1 wherein said first refractive surface is convex, said second refractive surface is flat or concave and wherein said means for removeably attaching said lens positions said convex, first refractive surface to confront a reflecting surface of said mirror.

3. The device of claim 1 wherein said magnifying lens has an optical power approximately equivalent to a power of an eyeglass normally worn by a user of said device.

4. The device of claim 1 wherein said first refracting surface is an aspheric surface.

5. The device of claim 1 further comprising means for removably attaching said mirror to a substantially vertical surface.

6. The device of claim 5 wherein said means for removably attaching said mirror to a substantially vertical surface further comprises means for selectively altering a separation of said mirror and said vertical surface.

7. The device of claim 5 wherein said first refracting surface is convex, and wherein said means for removeably attaching said lens positions said convex, first refracting surface to confront a reflecting surface of said mirror.

8. The device of claim 1 wherein said first refracting surface is a convex, aspheric surface, and wherein said means for removeably attaching said lens positions said convex, aspheric first refracting surface to confront a reflecting surface of said mirror.

9. An apparatus for providing prescription correction to a one of a plurality of mirror surfaces, comprising:

a magnifying lens comprising a coffective eyeglass lens blank a having a first and a second refracting surface and having a hole machined through said lens blank from said first refracting surface to said second refracting surface, said hole having a substantially constant cross-section;

a suction cup capable of removable attachment to said one of a plurality of mirror surfaces; and a hook element having a first end fitted through said hole and a second end attached to said suction cup.

10. The apparatus of claim 9 wherein said first refracting surface is convex, said second refractive surface is flat or concave, and wherein said suction cup and said hook position said lens such that said convex, first refracting surface confronts a reflecting surface of said mirror.

11. The apparatus of claim 9 wherein said magnifying lens has an optical power approximately equivalent to a power of an eyeglass normally worn by a user of said device.

12. The apparatus of claim 9 wherein said first refracting surface is aspheric.

13. The apparatus of claim 9 further comprising a second suction cup capable of removable attachment to a substantially vertical surface; and a lateral pivot connection comprising a first and a second arm connected by a pivot joint, said lateral pivot connection connecting said second suction cup to said mirror of said apparatus.

14. The apparatus of claim 9 further comprising a second suction cup capable of removable attachment to a substantially vertical surface; and a concertina connection connecting said second suction cup to said mirror of said apparatus.

15. The apparatus of claim 14 wherein said wherein said first refracting surface is convex, and wherein said suction cup positions said convex, first refracting surface to confront a reflecting surface of said mirror.

16. The apparatus of claim 9 wherein said first refracting surface is convex and aspheric, and wherein said suction cup and said hook element position said convex, aspheric first refracting surface to confront a reflecting surface of said mirror.

* * * * *